US006842581B2

(12) United States Patent
Schafer

(10) Patent No.: US 6,842,581 B2
(45) Date of Patent: Jan. 11, 2005

(54) BODY DRIER WITH INTERCONNECTED CYLINDRICAL AIR BLOWER HOUSINGS

(76) Inventor: Neil Schafer, 1026 Hardman Ave., Napa, CA (US) 94558

( * ) Notice: Subject to any disclaimer, the term of this patent is extended or adjusted under 35 U.S.C. 154(b) by 0 days.

(21) Appl. No.: 10/423,653

(22) Filed: Apr. 28, 2003

(65) Prior Publication Data

US 2004/0213559 A1 Oct. 28, 2004

(51) Int. Cl.[7] ..... F26B 19/00; F24H 3/00

(52) U.S. Cl. ..... 392/380; 392/382; 392/367; 34/90; 34/96

(58) Field of Search ..... 392/380, 382, 392/365–369, 381; 34/90–91, 97–98

(56) References Cited

U.S. PATENT DOCUMENTS

| | | | | |
|---|---|---|---|---|
| 1,208,327 | A | * 12/1916 | Keegan | 432/266 |
| 1,637,488 | A | * 8/1927 | Knopp | 34/97 |
| 2,856,700 | A | * 10/1958 | Wales | 34/91 |
| 4,703,152 | A | * 10/1987 | Shih-Chin | 392/366 |
| 4,760,243 | A | * 7/1988 | Tedioli | 392/366 |
| 4,961,272 | A | * 10/1990 | Lee | 34/90 |
| 5,103,577 | A | * 4/1992 | Michaels et al. | 34/91 |
| 5,837,972 | A | * 11/1998 | Padilla | 219/225 |
| 6,131,303 | A | * 10/2000 | Roper | 34/90 |
| 6,286,500 | B1 | * 9/2001 | Jones | 126/91 A |
| 6,321,034 | B2 | * 11/2001 | Jones-Lawlor et al. | 392/367 |
| 6,466,737 | B1 | * 10/2002 | Birdsell et al. | 392/367 |
| 2001/0028841 | A1 | * 10/2001 | Huang et al. | 415/60 |

FOREIGN PATENT DOCUMENTS

| | | |
|---|---|---|
| DE | 476657 | * 5/1929 |
| FR | 2136153 | * 11/1972 |
| GB | 2364638 | * 2/2002 |
| JP | 2-283342 | * 11/1990 |
| JP | 3-82418 | * 4/1991 |

* cited by examiner

*Primary Examiner*—John A. Jeffery
(74) *Attorney, Agent, or Firm*—Michael Shippey

(57) ABSTRACT

Body Drier with a plurality of cylindrical housings, each housing retaining a heating coil, a fan blade, an electric fan motor, a fan bracket and a fan grill. Each cylindrical fan housing assembly is attached to the one above it by means of standard electrical connectors. The cylindrical housings each have a cut out portion to allow warm air to flow out from the fan. Each cut out portion is covered by a grill. The cylindrical housings each have a standard bayonet type attachment so that the housings can be attached one on top of the other creating a tower. The tower secured in an upright position by a base plate. A single power cord exits from the base plate so that the attached plug can be inserted into a standard wall socket. The body drier includes a standard oscillating mechanism that causes the tower to oscillate.

2 Claims, 6 Drawing Sheets

BODY DRIER WITH INTERCONNECTED CYLINDRICAL AIR BLOWER HOUSINGS

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of portable electric heaters and more specifically to a body drier.

Heater fans are well known. They are generally comprised of a fan blade and attached motor and a heating element placed in front of the fan. The fan andheater assembly are placed inside a housing having a grill for hot air to exit from. Portable heater fans have taken numerous forms. Some room heaters have oscillating mechanisms built in to spread the heat more evenly around the room. Additionally, hair driers are well known and consist of a housing having a barrel portion and a handle portion. The barrel portion includes a heating element and a fan assembly. Although hair driers work well for their intended purpose, they are not sufficient to dry an entire body effectively.

Likewise, a typical portable room heater fan does not heat a large enough surface area to effectively dry a persons body. People generally dry their bodies after a shower or bath using a standard absorbent towel, however, In a cold environment, after exiting a warm shower or tub, it would be an added benefit to be able to stand in front of a column of warm air during the drying process. Indeed, if the warm air stream is sufficient, it may be possible to dry one's body entirely by use of warm air without need for a towel.

BRIEF SUMMARY OF THE INVENTION

The primary object of the invention is to provide a means to dry one's body using forced warm air.

Another object of the invention is to provide a body drier that can be modified to a variety of tower heights.

Another object of the invention is to provide a body drier that easily fits in a standard home bathroom.

A further object of the invention is to provide a body drier that oscillates to blow dry the body thereby minimizing the need for the user to move during the drying process.

Yet another object of the invention is to provide a body drier that delivers uniform warm air along the entire length of the drying tower.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed Body Drier comprising: a plurality of cylindrical housings, a plurality of heating coils, a plurality of axial fan blades, a plurality of electric fan motors, a plurality of fan and heating coil holding brackets, a plurality of housing fan grills, a plurality of male and female electrical connection means, a base plate, a power cord and attached plug and an on-off switch. Said cylindrical housings each enclosing said heating coil, said fan blade, said fan and heating coil holding bracket. Said cylindrical housings each having a cut out portion to allow warm air to flow out from said fan. Each said cut out portion covered by said grill. Said cylindrical housings each having a standard bayonet type attachment means, said attachment means having a female type at one end of said cylindrical housing and a mating male connection means at the opposite end of said cylindrical housing. Said heater coils and fan motors having attached power cords that each terminate in said electrical connection means so that each fan and heater assembly can be attached to the one below it. Said cylindrical housings capable of stacking one on top of the other on said base plate creating a body drying tower. A single said power cord exits from said base plate so that said attached plug can be inserted into a standard wall socket. An additional feature includes an oscillabng mechanism to cause the tower to oscillate to the left and right.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
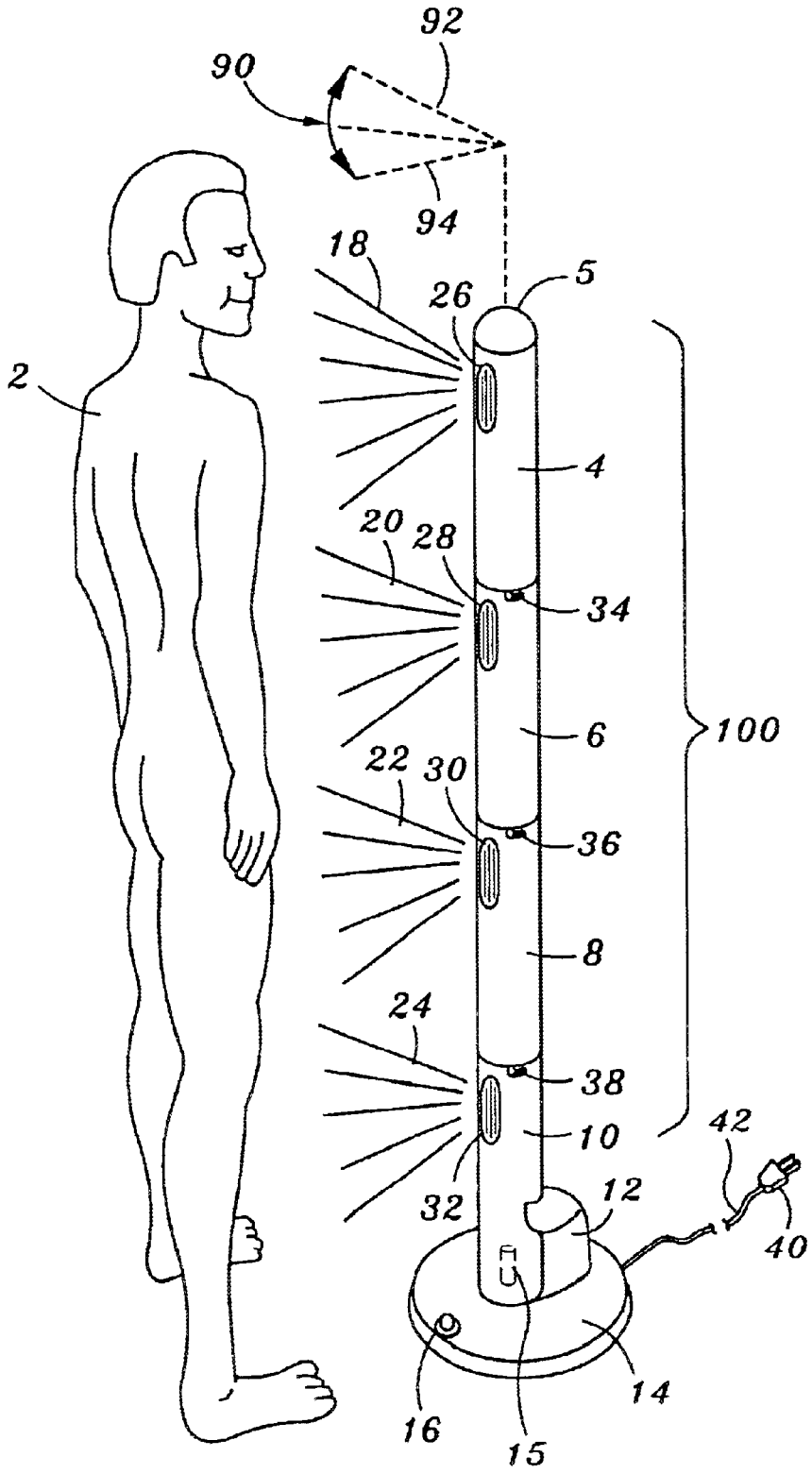
FIG. 1 is a perspective view of a person using the body drier of the present invention.

Referring now to FIG. 1 we see a person 2 standing in front of the body drier 100 of the present invention. The body drier 100 consists of a plurality of cylindrical housings 4, 6, 8, 10 each stacked on the other forming a tower. A base plate 14 having a post shown by dotted line 15 rises vertically and interacts with an aperture located on the underside of cylinder 10 thereby supporting the tower in an upright position. A cap 5 terminates the uppermost cylindrical housing. The body drying tower is powered by normal home power as accessed by power cord 42 and attached plug 40. The cylindrical housings have air exit apertures covered by grills 26, 28, 30, 32. The unit 100 can be turned on off by foot switch 16. In this figure, the person 2 is being dried evenly because warm air 18, 20, 22, 24 is being forced out of each grill 26, 28, 30, 32. Since each cylindrical section 4, 6, 8, 10 has its own heating element and fan, as will be discussed in detail below, the warm air emanating from the body drier 100 is evenly warm from top to bottom. Arrows 90 and dotted lines 92, 94 show the path of the oscillating motion as provided by an oscillating mechanism under housing 12 as will be explained in more detail below. The cylindrical housings are attached to each other by bayonet fittings 34, 36, 38 as will be discussed in more detail below.

Figure 2:
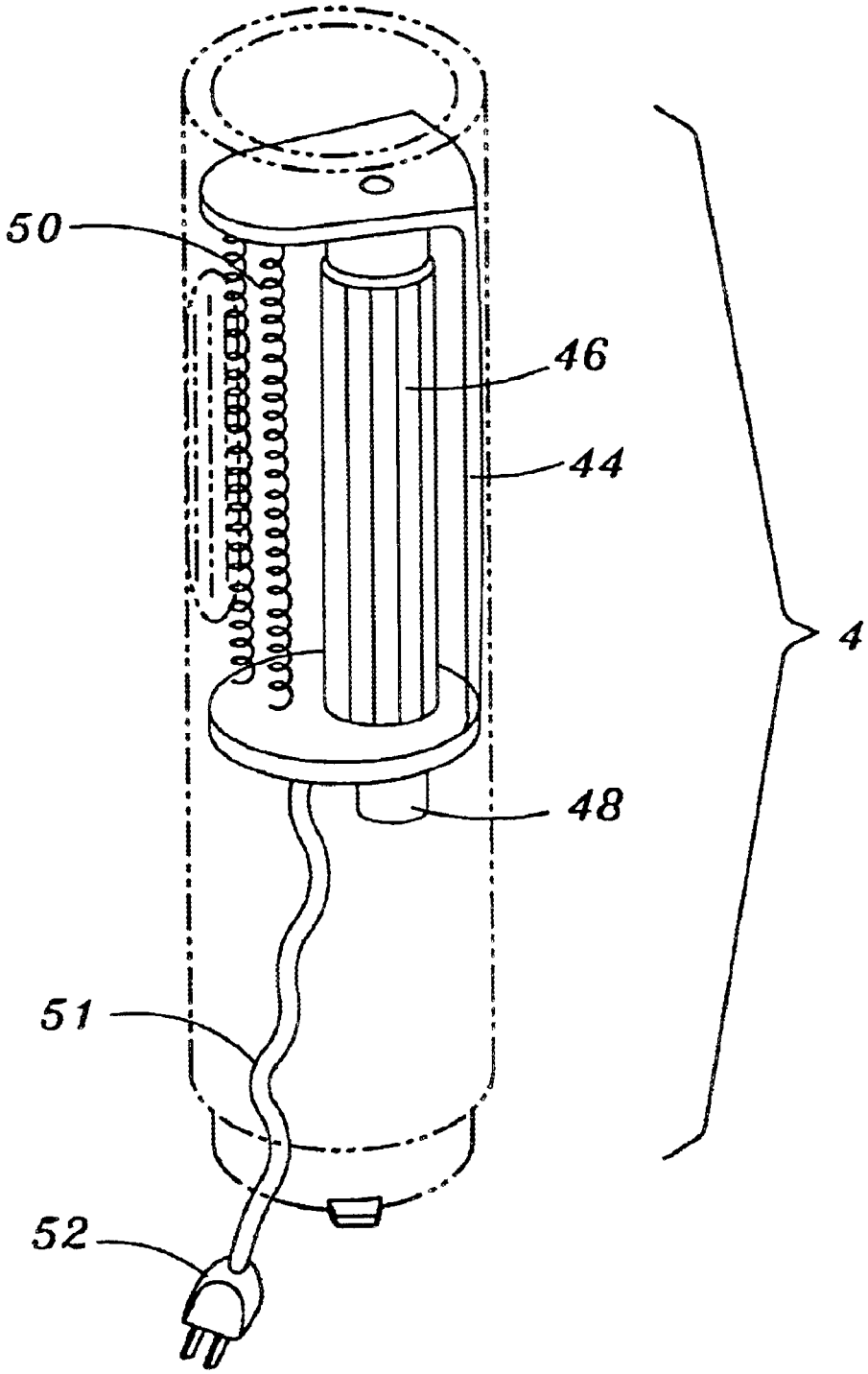
FIG. 2 is a view of the internal heating assembly of the present invention.

FIG. 2 shows a phantom view of cylindrical housing 4 so that the items inside can be seen. A bracket 44 holds in place fan blade 46 and fan motor 48, as well as heater elements 50. The bracket 44 is attached to the inside wall of housing 4. A power cord 51 terminates in plugs 52, 54, 56 that can plug into a receptacles 58, 60, 62 respectively heater housings 6, 8, 10 below as shown in FIG. 3.

Figure 3:
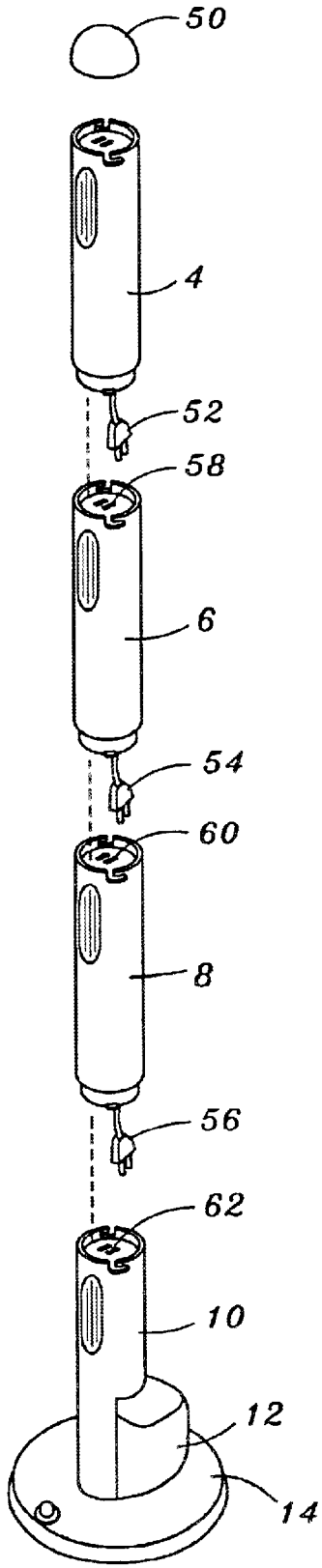
FIG. 3 is an exploded view of the present invention

FIG. 3 shows how the housings 4, 6, 8, 10 can attach to each other. Obviously, the tower can be made taller or shorter by adding or removing housing elements. Cap 50 encloses the top most housing 4.

Figure 4:
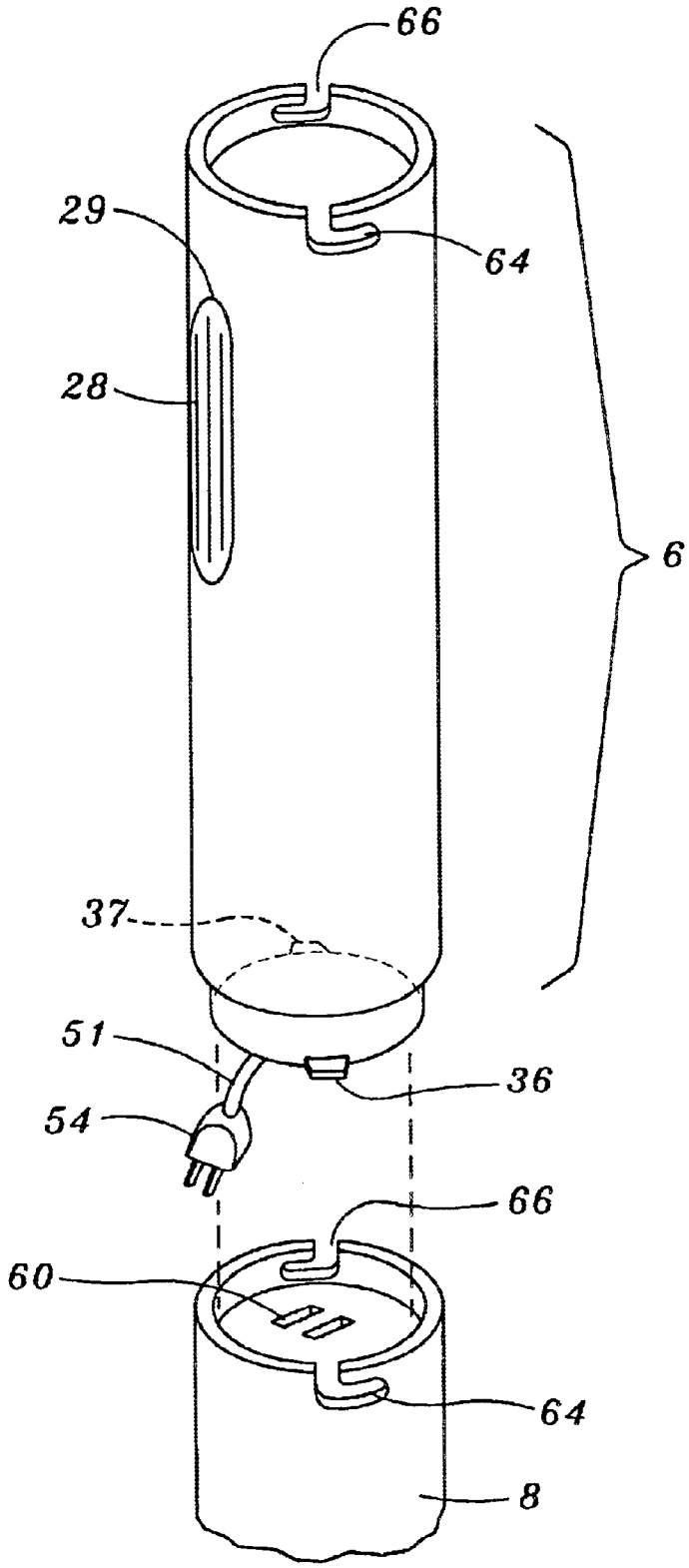
FIG. 4 is a partial view showing the attachment means for fastening one heating cylinder to the next.

FIG. 4 shows a more detailed view of the attachment means for each housing 6, 8. A pair of tabs 36, 37 interact with L shaped cutouts 64, 66. The housing 6 is pressed onto housing 8 and then turned to the right so that tabs 36, 37 are locked. Obviously, other standard attachment means can be used. Grill 28 can be more clearly seen covering aperture 29. Plug 54 can be dearly seen as ready to insert into socket 60. This modular configuration is helpful for building towers of different heights as well as for compact, effecient packaging and shipping.

Figure 5:
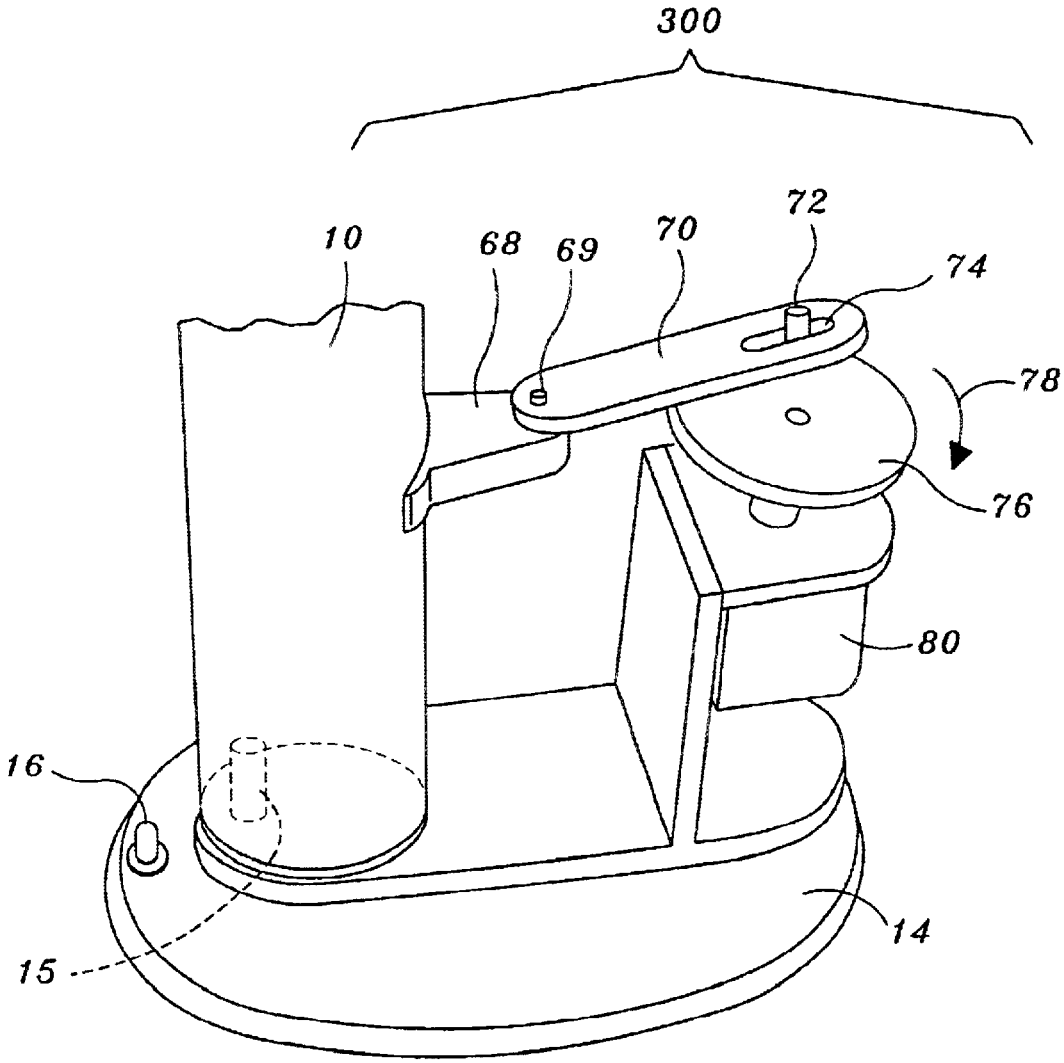
FIG. 5 is perspective view of the oscillating mechanism.

FIG. 5 shows a view of the oscillating mechanism 300 that is normally hidden under housing 12. AC gear reduction motor 80 powers disk 76 to spin at approximately one revolution per second as shown by arrow 78. Post 72 interacts with slot 74 of linkage arm 70. Linkage arm 70 is pinned 69 to housing bracket 68. Post 15 as shown by dotted line holds housing 10 in an upright position and also acts as a swivel point so that when oscillating mechanism 300 is in effect, the housing 10 is caused to swing from left to right approximately thirty degrees in a one oscillation per second time frame. The oscillating motion helps dry a person without the person having to move excessively.

Figure 6:
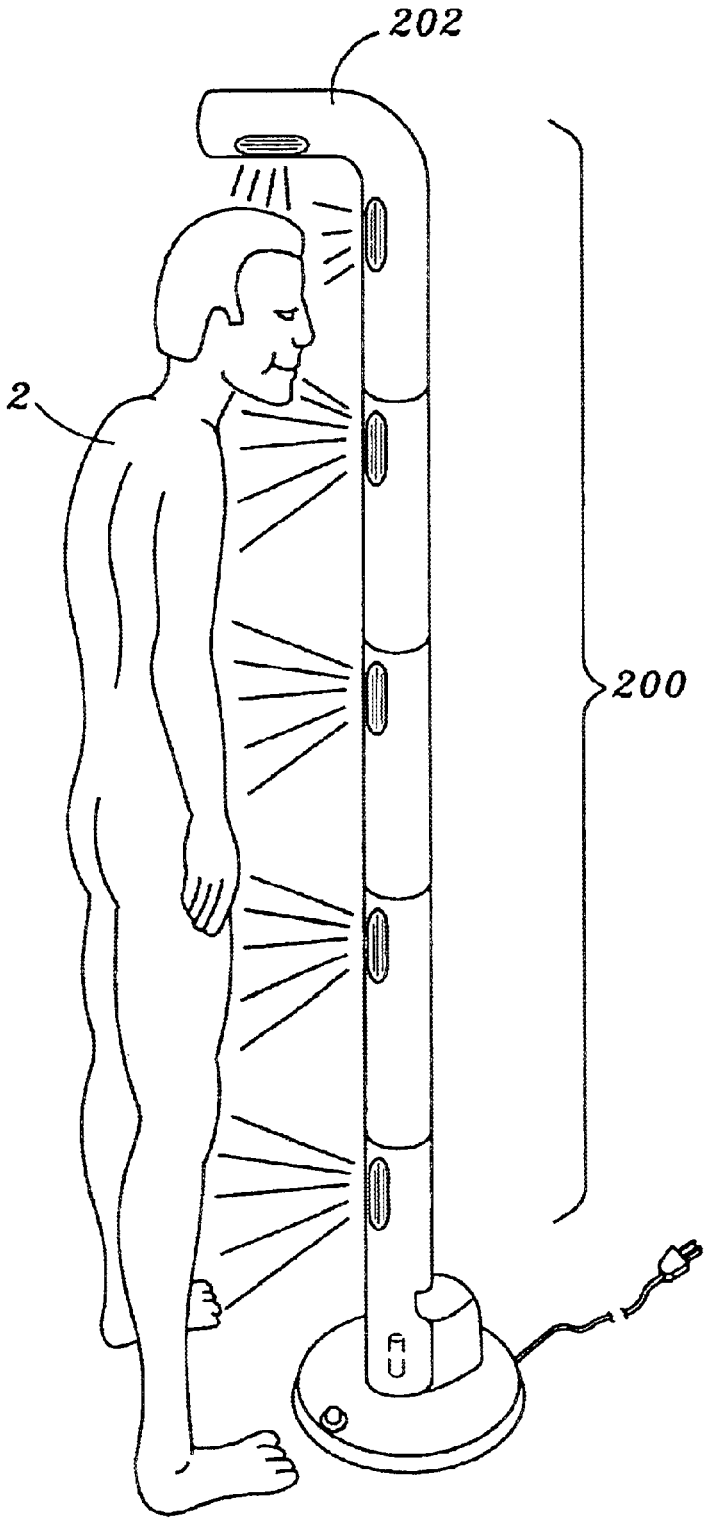
FIG. 6 is a perspective view of an alternate embodiment including a hair drying element.

FIG. 6 shows an alternate embodiment 200 where an L shaped housing 202 is added to help dry the user's 2 hair. Obviously, an additional drier assembly could be located near the user's feet to speed drying of that portion of the body.

The above description and figures show a novel drying device that provides an effective method of quickly and comfortably drying a person's body after a bath or shower or the like.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A Body Drier comprising:

a plurality of clindrical housings;

a plurality of heating coils;

a plurality of axial fan blades;

a plurality of electric fan motors;

a plurality of fan and heating coil holding brackets;

a plurality of housing fan grills;

a plurality of male and female electrical connection means;

a base plate;

a power cord and attached plug;

an on-off switch;

said cylindrical housings each enclosing said heating coil, said fan blade, said fan and heatina coil holdina bracket;

said cylindrical housings each having a cut out portion to allow warm air to flow out from said fan;

each said cut out portion covered by said grill;

said cylindrical housings each having a standard bayonet type attachment means;

said attachment means having a female type at one end of said cylindrical housing and a mating male connection means at the opDosite end of said cylindrical housing;

said heater coils and fan motors having attached power cords that each terminate in said electrical connection means so that each fan and heater assembly can be attached to the one below it;

said cylindrical housings capable of stacking one on ton of the other on said base plate creating a body drying tower;

a standard oscillating mechanism including a gear reduced motor, an attached shaft mounted disk and a slidably attached linkage attached to Dost located on said disk;

said drying tower being is capable of oscillating by means of said oscillating mechanism;

said oscillating mechanism being covered by an oscillator housing;

said lowest cylindrical heater housing having an aperture located on its underside that can receive a stationary post mounted on said base plate;

said lowest cylindrical heater housing including a bracket fixedly attached to its outside surface that can engage with said oscillating mechanism so that said tower can pivot in an oscillating fashion about said stationary post;

wherein said power cord exits from said base Dlate so that said attached olug can be inserted Into a standard wall socket.

2. A Body Drier comprising:

a plurality of cylindrical housings;

a plurality of heating coils;

a plurality of axial fan blades;

a plurality of electric fan motors;

a plurality of fan and heating coil holding brackets;

a plurality of housing fan grills;

a plurality of male and female electrical connection means;

a base plate;

a power cord and attached plug;

an on-off switch;

said cylindrical housings each endosing said heating coil, said fan blade, said fan and heating coil holding bracket;

said cylindrical housings each having a cut out portion to allow warm air to flow out from said fan;

each said cut out portion covered by said grill;

said cylindrical housings each having a standard bayonet type attachment means;

said attachment means having a female type at one end of said cylindrical housing and a mating male connection means at the opposite end of said cylindrical housing;

said heater coils and fan motors having attached power cords that each terminate in said electrical connection means so that each fan and heater assembly can be attached to the one below it;

said cylindrical housings capable of stacking one on top of the other on said base plate creating a body drying tower and said a single said power cord exits from said base plate so that said attached plug can be inserted into a standard wall socket;

said drying tower being capable of oscillating by means of said oscillating mechanism;

said oscillating mechanism covered by an oscillator housing;

said lowest cylindrical heater housing having an aperture located on its underside that can receive a stationary post mounted on said base plate;

said lowest cylindrical heater housing including a bracket fixedly attached to its outside surface that can engage with said oscillating mechanism so that said tower can pivot in an oscillating fashion about said stationary post.

* * * * *